US008616857B2

(12) United States Patent
Kai et al.

(10) Patent No.: US 8,616,857 B2
(45) Date of Patent: Dec. 31, 2013

(54) OIL PUMP UNIT WITH VARIABLE FLOW RATE

(75) Inventors: Keiichi Kai, Isesaki (JP); Junichi Miyajima, Isesaki (JP); Noriyuki Kawamata, Wako (JP); Toshimasa Mitsubori, Wako (JP); Satoshi Ino, Wako (JP)

(73) Assignees: Yamada Manufacturing Co., Ltd., Kiryu-Shi (JP); Honda Motor Co., Ltd., Tokyo (JP)

( * ) Notice: Subject to any disclaimer, the term of this patent is extended or adjusted under 35 U.S.C. 154(b) by 159 days.

(21) Appl. No.: 13/228,969

(22) Filed: Sep. 9, 2011

(65) Prior Publication Data

US 2012/0070318 A1 Mar. 22, 2012

(30) Foreign Application Priority Data

Sep. 16, 2010 (JP) ..... P2010-208448

(51) Int. Cl.

| | |
|---|---|
| ***F04B 49/00*** | (2006.01) |
| ***F04B 23/04*** | (2006.01) |
| ***F04B 41/06*** | (2006.01) |
| ***F01M 1/02*** | (2006.01) |

(52) U.S. Cl.

USPC ..... 417/286; 417/287; 417/426; 417/427; 123/196 R

(58) Field of Classification Search

USPC ..... 417/286, 287, 426, 427

See application file for complete search history.

(56) References Cited

U.S. PATENT DOCUMENTS

| | | | | |
|---|---|---|---|---|
| 2,799,139 | A * | 7/1957 | Becker | 60/396 |
| 3,427,825 | A * | 2/1969 | John et al. | 464/159 |
| 3,873,241 | A * | 3/1975 | Motomura | 417/283 |
| 3,951,575 | A * | 4/1976 | Motomura et al. | 417/283 |
| 4,204,811 | A * | 5/1980 | Carter et al. | 417/288 |
| 4,347,044 | A * | 8/1982 | Ahlen et al. | 417/253 |
| 4,538,966 | A * | 9/1985 | Nikaido | 417/288 |
| 4,850,813 | A | 7/1989 | Fisher | |
| 5,609,474 | A * | 3/1997 | Ohno | 417/288 |
| 5,918,573 | A * | 7/1999 | Killion | 123/192.2 |
| 6,672,399 | B2 * | 1/2004 | Sprinkle et al. | 172/7 |
| 6,719,080 | B1 * | 4/2004 | Gray, Jr. | 180/165 |
| 6,732,700 | B2 * | 5/2004 | Suganuma | 123/196 R |

(Continued)

FOREIGN PATENT DOCUMENTS

| | | | |
|---|---|---|---|
| DE | 3906477 C2 | 12/1992 | |
| GB | 2340551 A * | 2/2000 | F04C 11/00 |

(Continued)

OTHER PUBLICATIONS

Japanese Office Action mailed Dec. 21, 2012 and English Translation, 6 pages.

(Continued)

*Primary Examiner* — Thanh Truong
*Assistant Examiner* — Tea Holbrook
(74) *Attorney, Agent, or Firm* — Rankin, Hill & Clark LLP

(57) ABSTRACT

An oil pump unit with a variable flow rate includes lubrication pumps and a control pump that are driven by rotation of a crankshaft of an engine, and changes an oil supply amount from the control pump to each part of the engine, in which the control pump includes a plurality of oil pumps that have different discharge rates.

7 Claims, 10 Drawing Sheets

(56) References Cited

U.S. PATENT DOCUMENTS

| | | | | |
|---|---|---|---|---|
| 7,007,655 | B2 * | 3/2006 | Yamamoto | 123/196 R |
| 7,178,498 | B2 * | 2/2007 | Takeuchi | 123/196 R |
| 7,290,991 | B2 * | 11/2007 | Staley et al. | 417/286 |
| 2002/0003063 | A1 * | 1/2002 | Ito et al. | 184/6.5 |
| 2003/0085090 | A1 * | 5/2003 | Kasuya et al. | 192/35 |
| 2004/0244761 | A1 * | 12/2004 | Takeuchi | 123/196 R |
| 2005/0265860 | A1 * | 12/2005 | Kameya et al. | 417/410.4 |
| 2006/0213477 | A1 * | 9/2006 | Schulz-Andres et al. | 123/196 R |
| 2008/0107545 | A1 * | 5/2008 | Hoji | 417/307 |
| 2009/0056655 | A1 * | 3/2009 | Kobayashi et al. | 123/90.17 |

FOREIGN PATENT DOCUMENTS

| | | | | |
|---|---|---|---|---|
| JP | 1-145909 U | | 10/1989 | |
| JP | 02-153281 | | 6/1990 | |
| JP | 02153281 A | * | 6/1990 | F04C 2/10 |
| JP | 08-093428 | | 4/1996 | |
| JP | 2008-223755 | | 9/2008 | |

OTHER PUBLICATIONS

German Search Report and Translation, Application No. 102011082515.0, mailing date Sep. 12, 2012, 10 pages.

* cited by examiner

OIL PUMP UNIT WITH VARIABLE FLOW RATE

BACKGROUND OF THE INVENTION

1. Field of the Invention

The present invention relates to an oil pump unit with a variable flow rate that is suitable for an engine of a vehicle or the like.

2. Description of Related Art

In the related art, as the oil pump unit with a variable flow rate, there has been disclosed an oil pump unit with a variable flow rate that includes a lubrication pump and a control pump, which are driven by rotation of the crankshaft of an engine, and an oil path switching valve at the discharge port of the control pump, and controls the discharging amount of the entire pump by switching the discharge port of the control pump to communicate with oil supply channels for each part of the engine or not, by operating the oil path switching valve (For example, Japanese Unexamined Patent Application First Publication No. 2008-223755).

Further, there has been disclosed an oil pump unit with a variable flow rate that includes the lubrication pump and the control pump on the same axis, in which the pump rotor of the lubrication pump is fixedly supported by a driving shaft while the pump rotor of the control pump is separably supported by the driving shaft through a magnet, such that the control pump is switched to operate or not in accordance with the number or rotation of the driving shaft (for example, see Japanese Unexamined Patent Application First Publication No. H02-153281)

SUMMARY OF THE INVENTION

However, in the configuration of the related art, the discharge amount of the entire pump is controlled by whether oil is supplied from the control pump to the engine, but it is required to further reduce a pump driving force by allowing control of a smaller discharge amount.

Therefore, it is an object of the present invention to further reduce a pump driving force by allowing control of a smaller discharge amount in an oil pump unit with a variable flow rate including a lubrication pump and a control pump.

According to a first, aspect, an oil pump unit with a variable flow rate includes lubrication pumps and a control pump that are driven by rotation of a crankshaft of an engine, and changes an oil supply amount from the control pump to each part of the engine, in which the control pump includes a plurality of oil pumps that have different discharge rates.

According to a second aspect, an oil pump unit with a variable flow rate includes lubrication pumps and a control pump that are driven by rotation of a crankshaft of an engine, and includes an oil path switching valve that switches a discharge port of the control pump to communicate or not with a supply channel leading to each part of the engine such that an oil supply amount from the control pump to each part of the engine is variable, in which the control pump includes a plurality of oil pumps that have different discharge rates, and one of the oil pumps is a main pump that is kept communicating with the supply channel for a part of the engine while the other of the oil pumps is a sub-pump that is switched to communicate or not with the supply channel by operation of the oil path switching valve, and the discharge rate of the sub-pump is set to be larger than the discharge rate of the main pump.

According to a third aspect, the oil path switching valve is operated by a discharge pressure from the main pump.

According to a fourth aspect, the lubrication pumps and the control pump are disposed on a same axis.

According to a fifth aspect, the main pump and the sub-pump share a single pump body and the main pump is disposed at the outer side of the pump body than the sub-pump in the axial direction of the main pump and the sub-pump.

According to a sixth aspect, a pump driving unit is disposed at a side of the main pump in the axial direction of the main pump and the sub-pump.

According to a seventh aspect, the main pump and the sub-pump have the same discharge cycle and an about half-cycle phase difference.

According to an eighth aspect, the lubrication pumps and the control pump share a single driving shaft, a plurality of engaging portions that is engaged with pump rotors of the pumps in a non-relative rotatable state is formed at the driving shaft, and a gap is set between the engaging portions and engaged portions of the pump rotors that are engaged with the engaging portions, respectively, in the axial direction of the driving shaft.

According the present invention described in first and second aspects, since it is possible to more fine control the discharge amount of entire the pump, as compared with a control pump includes a single oil pump, it is possible to further reduce a pump driving force.

Further, according to the invention described in second aspect, it is possible to increase the control width of the discharge amount of the entire pump and further reduce the pump driving force, by making the discharge amount of the sub-pump, which is switched to communicate or not with the oil supply channels to each part of the engine by the operation of the oil path switching valve, larger than the discharge amount of the main pump that is kept communicating with the oil supply channels to each part of the engine.

According to the invention described in third aspect, it is possible to easily operate the oil path switching valve, using the discharge pressure of the main pump, and the oil path switching valve may also be used as a relief valve of the main pump.

According to the invention described in fourth aspect, it is possible to reduce the size, weight, and cost by reducing the number of parts and simplifying the structure, as compared with the pumps are disposed on separate axes.

According to the invention described in fifth aspect, since it is possible to dispose the sub-pump that generates loud operation sound due to a relatively large discharge amount inside the pump body, it is possible to reduce the operation sound of the entire pump.

According to the invention described in sixth aspect, since it is possible to dispose the main pump that keeps receiving driving load close to the pump driving unit, it is possible to reduce the load at the driving shaft.

According to the invention described in seventh aspect, it is possible to effectively suppress pulsation that is generated by the main pump and the sub-pump.

According to the invention described in eighth aspect, since it is possible to absorb expansion and contraction, using the gap, when the expansion and contraction is generated in the driving shaft, it is possible to suppress an increase in friction of the pumps, even if the pump rotors are axially located with the sides of the pump rotors of the pumps in sliding contact with the inner side of the pump body.

DETAILED DESCRIPTION OF THE INVENTION

Hereinafter, the embodiments of the present invention are described with reference to the drawings. Further, in the following description, the front/rear/left/right directions are the directions based on a vehicle described below if not specifically stated. Further, an arrow of FR showing the front of the vehicle, an arrow LH showing the left of the vehicle, and an arrow UP showing the upper direction of the vehicle are shown at appropriate positions in the figures used in the following description.

Figure 1:
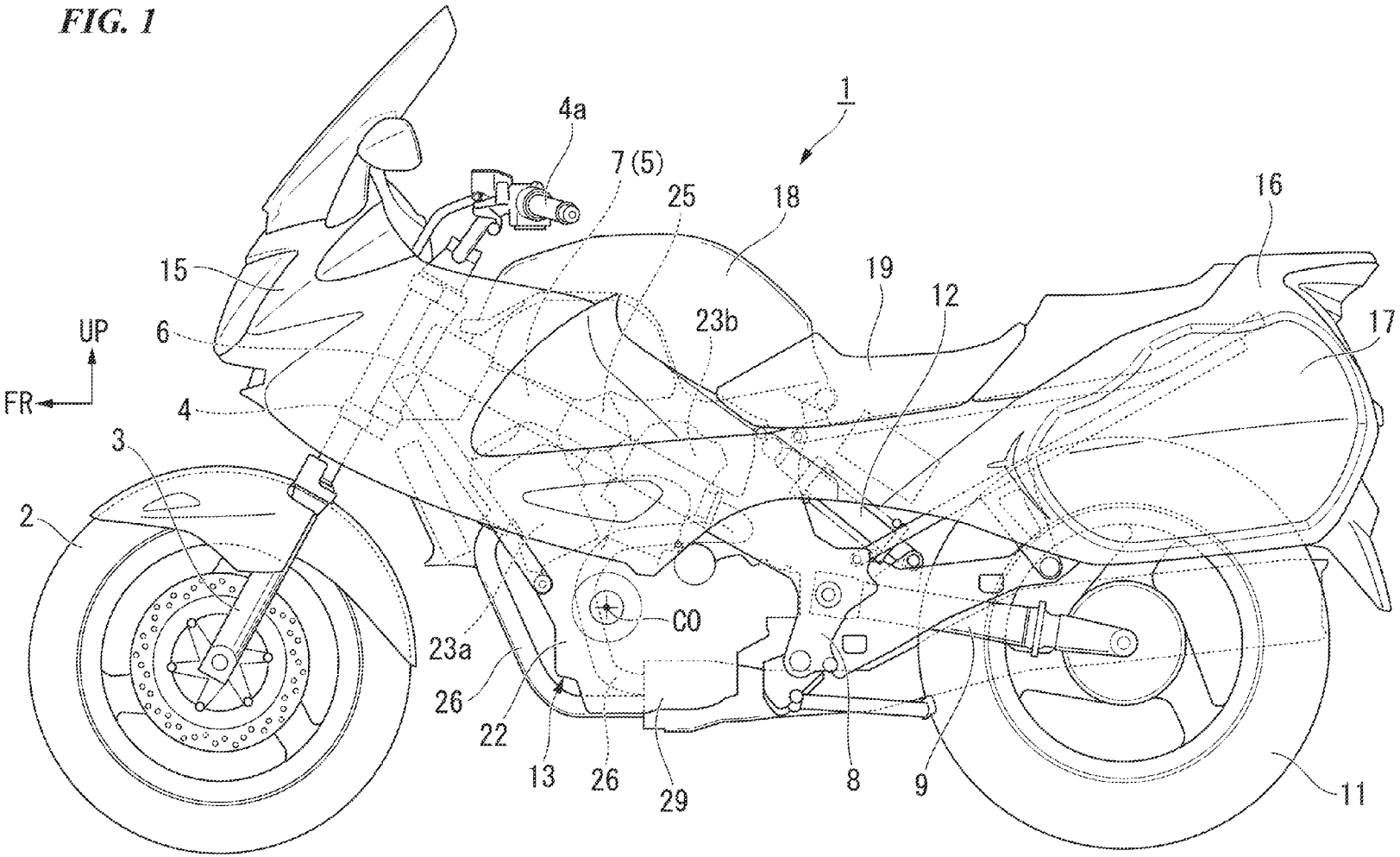
FIG. 1 is a left side view of a motorcycle according to an embodiment of the present invention.

In a motorcycle 1 (a saddle-typed vehicle) shown in FIG. 1, a front wheel 2 is supported by a shaft at the lower end portion of a front fork 3. The upper portion of the front fork 3 is steerably supported by a shaft at a head pipe 6 at the front end of a bodywork frame 5 through a steering stem 4. A steering handle 4*a* is mounted on the upper portion of the steering stem 4 (or the front fork 3). A main frame 7 extends rearward from the head pipe 6 and is connected to a pivot frame 8. The front end portion of a swing arm 9 is vertically swingably supported by a shaft at the pivot frame 8. A rear wheel 11 is supported by a shaft at the rear end portion of the swing arm 9. A cushion unit 12 is disposed between the swing arm 9 and the bodywork frame 5. An engine (internal combustion engine) 13 that is the motor of the motorcycle 1 is mounted in the bodywork frame 5.

The left arm of the swing arm 9 is hollow and a drive shaft introduced from the engine 13 is inserted in the left arm. Power is transmitted between the engine 13 and the rear wheel 11 through the drive shaft.

The front portion of the bodywork of the motorcycle 1 is covered by a front cowl 15 and the rear portion of the bodywork is covered by a rear cowl 16. Left and right pannier cases 17 are built in both read sides of the rear cowl 16. A fuel tank 18 is disposed above the main frame 7 and a seat 19 is disposed behind the fuel tank 18.

Figure 2:
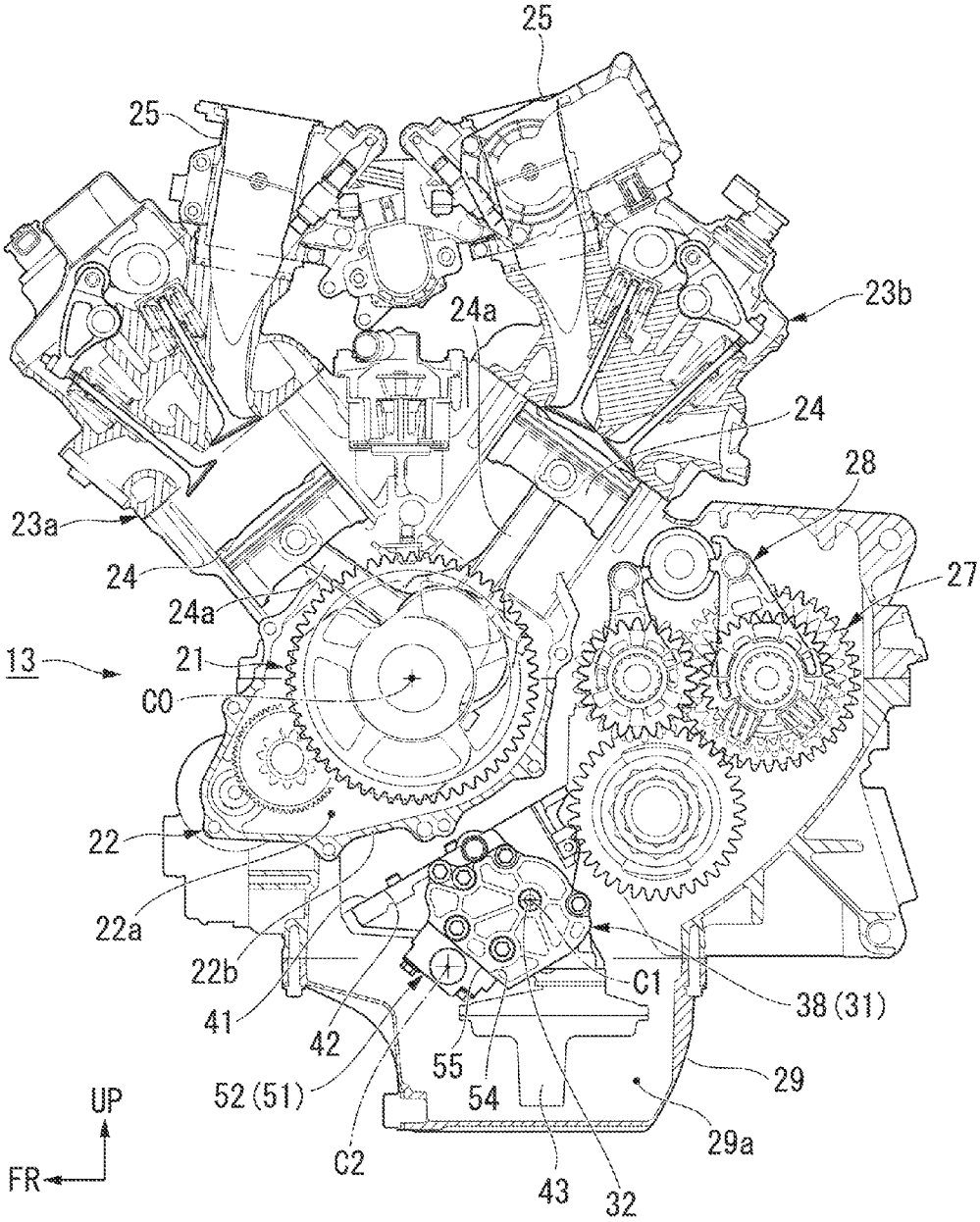
FIG. 2 is a left side view of an engine of the motorcycle.

Referring to FIG. 2, the engine 13 is a V-type engine with the rotational axial center line C0 of a crankshaft 21 is arranged in the vehicle width direction (left-right direction) and front and rear cylinders 23*a* and 23*b* are vertically disposed on a crank case 22. Pistons 24 are mounted to be able to reciprocate in the front and rear cylinders 23*a* and 23*b*, respectively, the reciprocation motion of the pistons 24 is converted into a rotation motion of the crankshaft 21 through a con rod 24*a*.

A throttle body 25 connected to the intake port is disposed between the front and rear cylinders 23*a* and 23*b*. An exhaust pipe 26 extending from the exhaust port is disposed ahead of the front cylinder 23*a* or behind the rear cylinder 23*b*.

Further, reference numeral "27" in the figure indicates a transmission accommodated in the rear portion of the crank case 22, reference numeral "28" indicates a change mechanism that switches the shift stages of the transmission 27, reference numeral "29" indicates an oil pan mounted at the lower portion of the crank case 22, and reference numeral "31" indicates an oil pump unit that sends an engine oil (hereafter, briefly referred to as an oil) in the oil pan 29 to each part of the engine under pressure.

Figure 3:
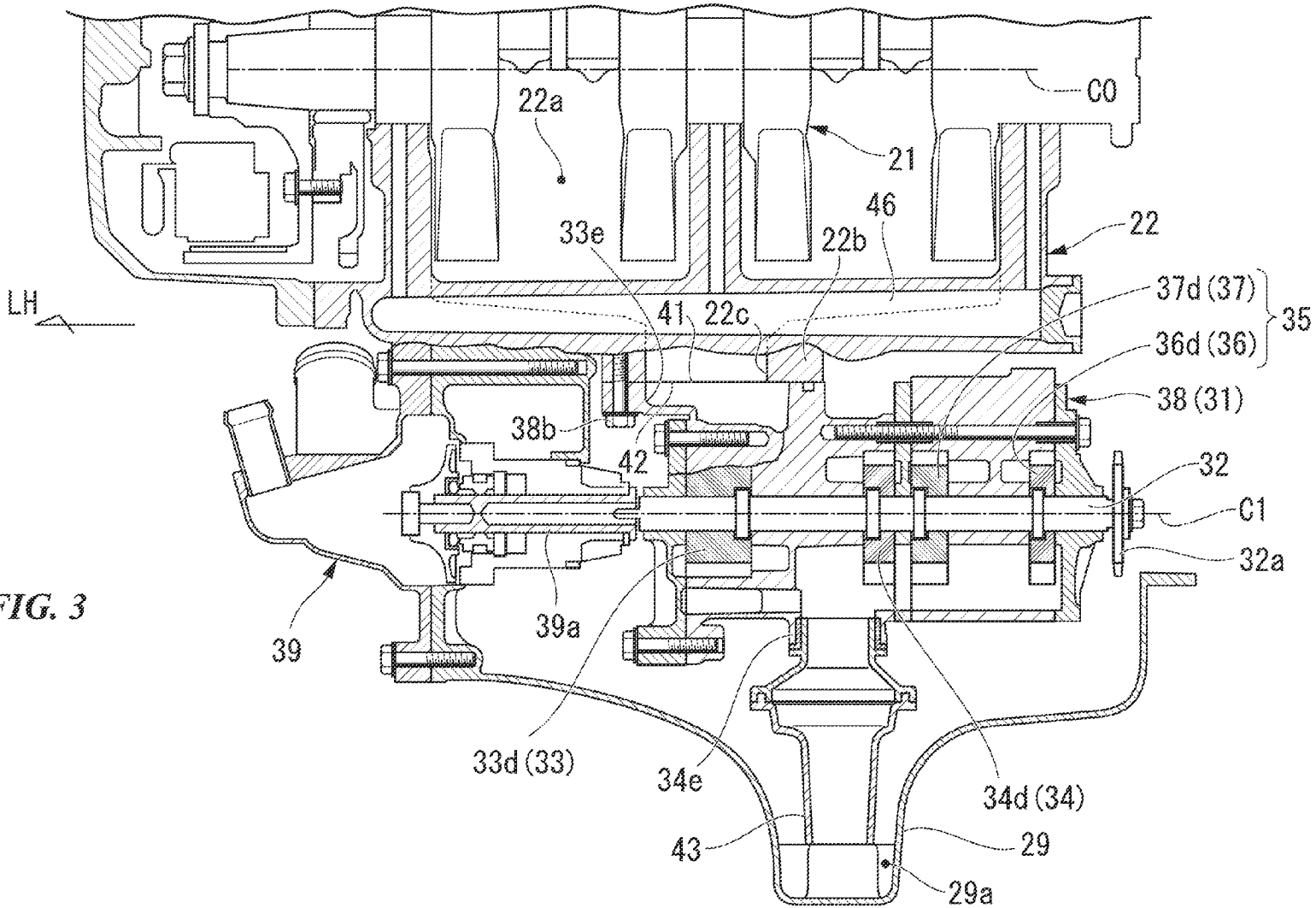
FIG. 3 is a cross-sectional view of the main parts of the engine, cut in parallel with the axial line of a crank shaft and seen from the rear.
Figure 4:
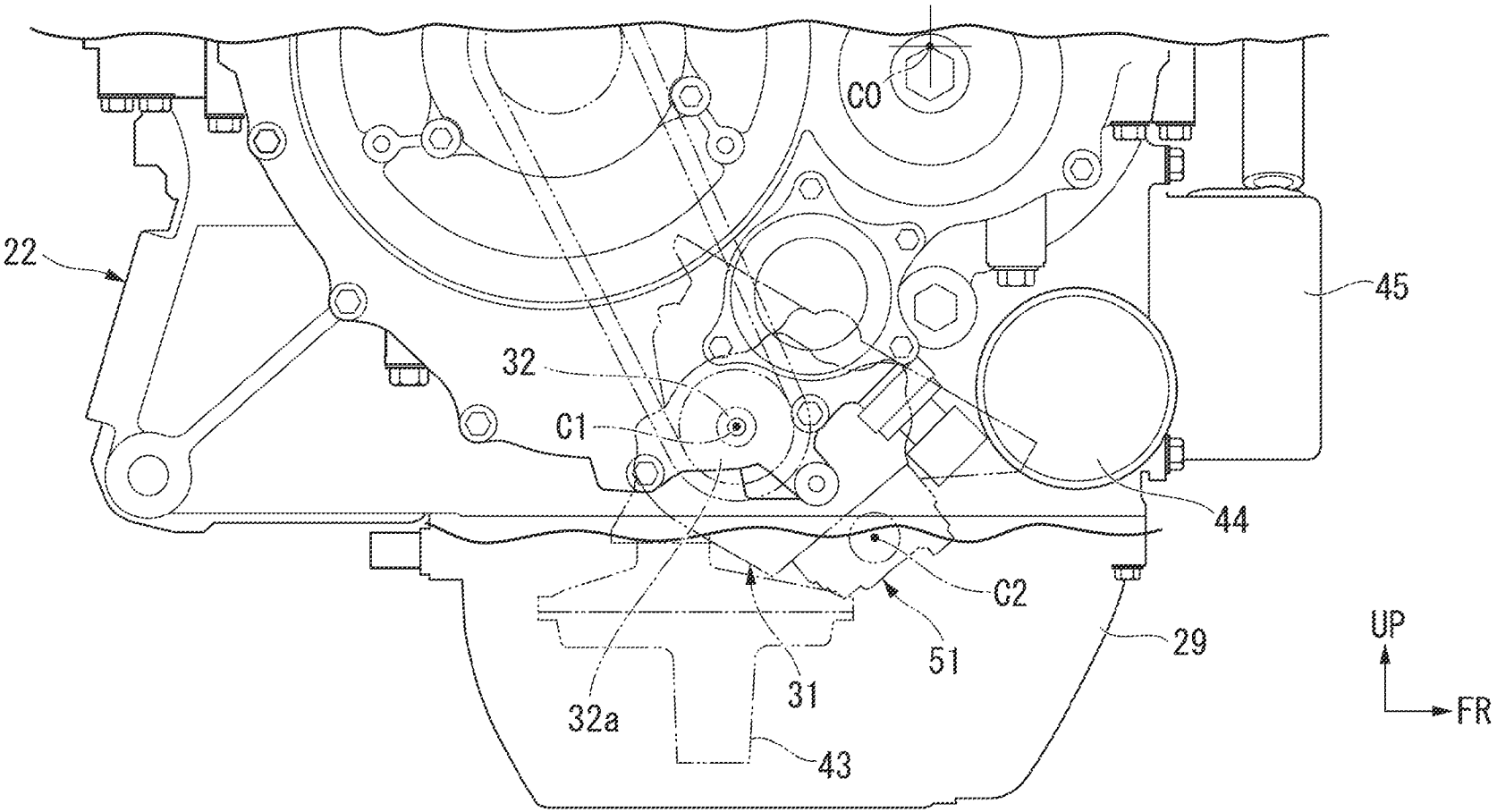
FIG. 4 is a right side view of the main parts of the engine.

Referring to FIGS. 2 to 4, the oil pump unit 31 is driven by rotation of a rotary member (crankshaft 21 or a clutch outer of a multiplate clutch to which the rotational power is kept transmitted) which is mounted inside the lower portion of the crank case 22 and keeps rotating when the engine is operated. The oil pump unit 31 includes a pump driving shaft 32 (hereafter, briefly referred to as a driving shaft) that is in parallel with the crankshaft 21. A driven member 32*a* (a driven sprocket) for operation with the rotary member is integrally rotatably mounted at the right end portion of the driving shaft 32. Further, reference numeral 'C1' indicates the rotation center axial line of the driving shaft 32.

Referring to FIG. 3, the oil pump unit 31 has a configuration in which a plurality of trochoidal type oil pumps is arranged in the left-right direction (in parallel with the crankshaft line C0).

In detail, the oil pump unit 31 has a configuration in which a scavenge pump 33, a feed pump 34, and a control pump 35 that generates an oil pressure for controlling an apparatus, such as a transmission or a valve gear, are sequentially arranged on the same axis from the left side.

The feed pump 34 sends the oil in the oil pan 29 under the crank case 22 toward oil supply positions of each part of the engine under pressure. The scavenge pump 33 returns the oil from a space (hereafter, referred to as a crank chamber 22*a*) accommodating the crankshaft 21 to a space (hereafter, referred to as an oil pan chamber 29*a*) in the oil pan 29, in the crank case 22. The control pump 35 supplies an oil pressure for the operation to the apparatus. Further, reference numeral '22*b*' in the figure indicates the bottom wall of the crank chamber 22*a*.

Figure 5:
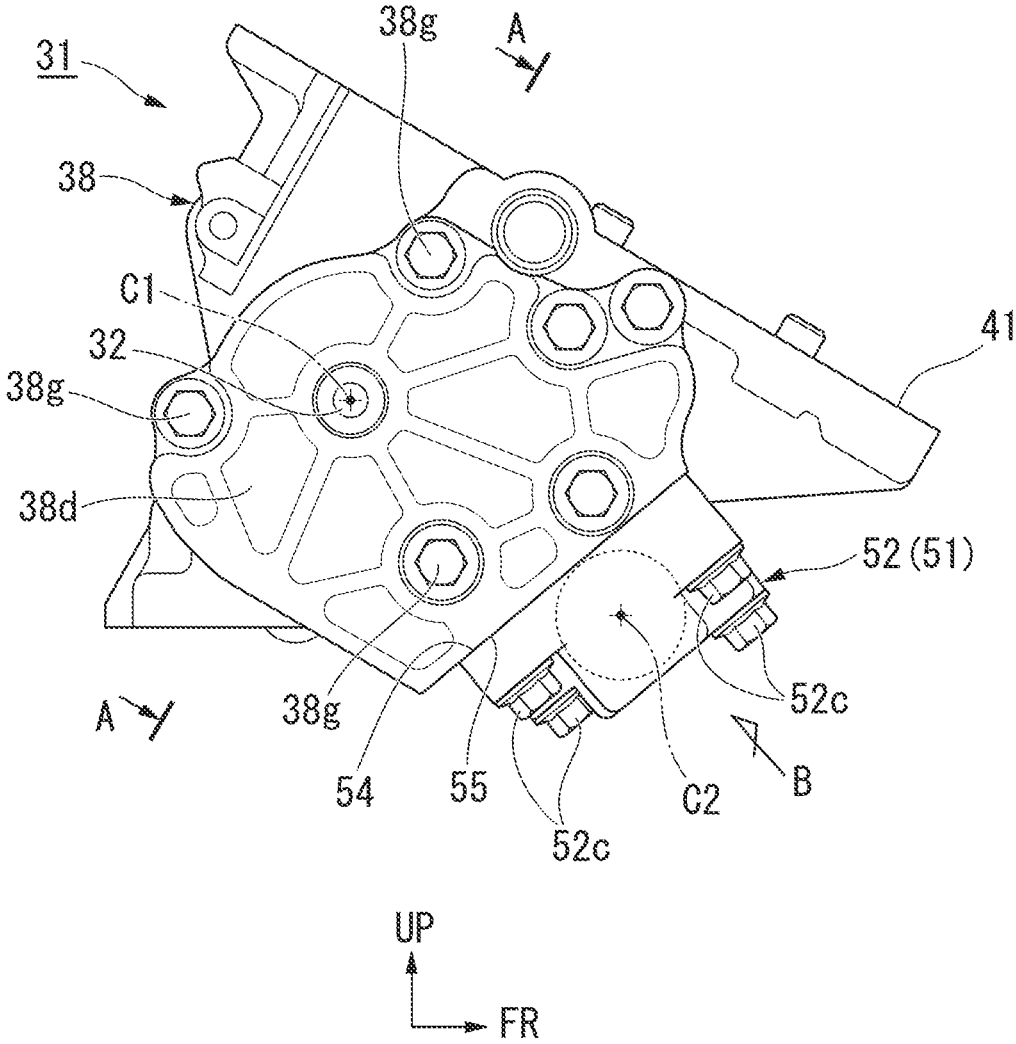
FIG. 5 is a right side view of an oil pump unit of the engine.
Figure 6:
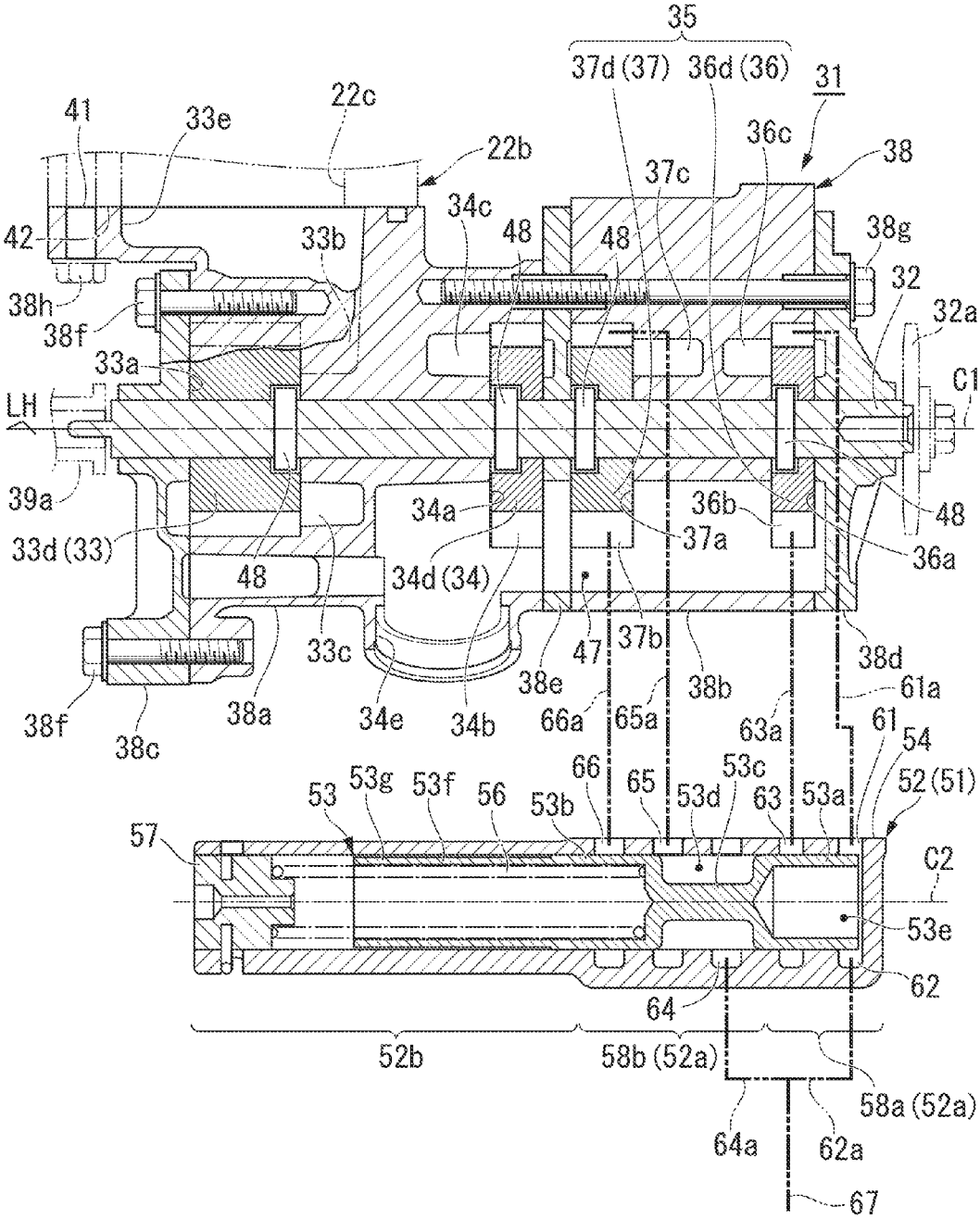
FIG. 6 is an illustrative view adding the cross-sectional view of an oil path switching valve to the cross-sectional view taken along the line A-A of FIG. 5.

Referring to FIGS. 5 and 6, the oil pump unit 31 includes a single pump body 38 and a driving shaft 32 and the pumps 33, 34, and 35 share them. The right end portion of the driving shaft 32 protrudes from the right end of the pump body 38 and the driven member 32*a* is fixed to the right end portion of the driving shaft 32. The left end portion of the driving shaft 32 protrudes from the left end of the pump body 38 and the right end portion of a driving shaft 39*a* of a water pump 39 (see FIG. 3) is integrally rotatably engaged with the left end portion of the driving shaft 32. That is, the water pump 39 includes the driving shaft 39*a* arranged in the left-right direction and the driving shaft 39*a* is disposed on the shame axis of the driving shaft 32 of the oil pump unit 31.

The pump body 38 is divided into a left section 38*a* that forms rotor receiving portions 33*a* and 34*a* for the feed pump 34 and the scavenge pump 33 and intake ports 33*b* and 34*b* and discharge ports 33*c* and 34*c*, a right section 38*b* that forms rotor receiving portions 36*a* and 37*a* for first and second oil pumps 36 and 37, which are described below, and intake ports 36*b* and 37*b* and discharge ports 36*c* and 37*c* in the control pump 35, a left cover body 38*c* that closes the left end of the left section 38*a*, a right cover body 38*d* that closes the right end of the right section 38*b*, and a separating plate 38*e* that is interposed between the left and right sections 38*a* and 38*b*.

The left cover body 38*c* is fastened and fixed to the left end of the left section 38*a* by a plurality of bolts 38*f* and the right cover body 38*d* is fastened and fixed to the right end of the left section 38*a* by a plurality of long bolts 38*g* passing through the right section 38*b* and the separating plate 38*e*. Accordingly, the sections 38*a* and 38*b*, the cover bodies 38*c* and 38*d*, and the separating plate 38*e* are integrally combined.

The rotor receiving portions 33*a* and 34*a* accommodate rotors 33*d* and 34*d* of the feed pump 34 and the scavenge pump 33, respectively. The pump rotors 33*d* and 34*d* each have a configuration composed of an outer rotor and an inner rotor, which is known in the art. The pump rotors 33*d* and 34*d* (inner rotors) can rotate integrally with the driving shaft 32 held at the center portion of the pump body 38.

Referring to FIG. 2, an engine-mounting surface 41 that is inclined forward and downward when the oil pump unit 31 is mounted on the engine 13 (motorcycle 1) is formed at the upper left portion of the pump body 38. The engine-mounting surface 41 is flat in the left-right direction and aligned in oil tight from under a pump-mounting surface 42 under the bottom wall 22*b* of the crank chamber 22*a*. In this state, the pump body 38 (oil pump unit 31) is fastened and fixed to the bottom wall 22*b* of the crank chamber 22*a* by a plurality of bolts 38*h*.

Referring to FIG. 6, the intake port 33*b* of the scavenge pump 33 is formed at the upper left side of the left section 38*a*. The intake port 33*b* extends toward the engine-mounting surface 41 above it and is opened at the engine-mounting surface 41 by an intake hole 33*e*. An opening 22*c* is formed at the pump-mounting surface 42 of the bottom wall 22*b* of the crank chamber 22*a*, opposite to the intake hole 33*e*. The intake hole 33*e* and the opening 22*c* communicate with each other, with the oil pump unit 31 mounted on the crank case 22.

The discharge port 33*c* that is open to the oil pan chamber 29*a* in the scavenge pump 33 is formed at the lower right side of the left section 38*a*. Accordingly, when the oil pump unit 31 is driven, the scavenge pump 33 sucks the oil in the crank chamber 22*a* through the intake port 33*b* and discharges and returns the oil to the oil pan chamber 29*a* through the discharge port 33*c*.

Referring to FIG. 2, the bottom wall 22*b* that is a separating wall separating the crank chamber 22*a* and the oil pan chamber 29*a* is formed in an arch shape along the rotation path of a crank web when seen from a side. The opening 22*c* is formed at the lower end portion of the bottom wall 22*b*.

Referring to FIGS. 3 and 4, the intake port 34*b* of the feed pump 34 is formed at the lower right side of the left section 38*a*. The intake port 34*b* opens the intake port 34*e* toward the oil pan chamber 29*a*, extending in a nozzle shape under it. The upper end portion of a strainer 43 sunk in the oil in the oil pan chamber 29*a* is connected to the intake port 34*e*.

The discharge port 34*c* that communicates with an oil supply channel to each part of the engine in the feed pump 34 is formed at the upper right side of the left section 38*a*. Accordingly, when the oil pump unit 31 is driven, the feed pump 34 sucks the oil in the oil pan chamber 29*a* through the strainer 43 by the intake port 34*b* and discharges and returns the oil to each part of the engine through the discharge port 34*c*. The oil discharged by the feed pump 34 reaches to a main oil gallery 46, for example, through an oil filter 44 and an oil cooler 45, and then is appropriately supplied to oil supply positions of each part of the engine.

Referring to FIG. 6, a communication space 47 that includes the intake port 34*b* of the feed pump 34 and the intake ports 36*b* and 37*b* of the first and second oil pumps 36 and 37 of the control pump 35 and extends to the left and right is formed at the lower portion of the pump body 38. The feed pump 34 and the first and second oil pumps 36 and 37 the oil introduced in the communication space 47 through the strainer 43 is suctioned through the intake ports 34*b*, 36*b*, and 37*b*.

The control pump 35 includes the first oil pump 36 and the second oil pump 37 arranged in parallel along the driving shaft 32 (in the left-right direction, hereafter, referred to as a pump axis direction).

The first oil pump 36 is a main pump that keeps communicate with an oil supply channel 67 extending to each part of the engine (the apparatus) and the second oil pump 37 is a sub-pump that switches the oil supply channel 67 to communicate or not by operation of an oil path switching valve 51, which is described below.

The first oil pump 36 accommodates the pump rotor 36*d* in the right oil receiving portion 36*a* of the right section 38*b* and the second oil pump 37 accommodates the pump rotor 37*d* in the left rotor receiving portion 37*a* of the right section 38*b*. That is, the first oil pump 36 is disposed at the outer side of the pump body 38 than the second oil pump 37 in the pump axis direction. The driven member 32*a* is disposed at the outer side than the first oil pump 36 in the pump axis direction.

The intake ports 36*b* and 37*b* of the first and second oil pumps 36 and 37 are open to the communication space 47 and the discharge ports 36*c* and 37*c* of the first and second oil pumps 36 and 37 are separately open to the upper portion of the pump body 38.

The intake ports 33*b*, 34*b*, 36*b*, and 37*b* of the first and second oil pumps 36 and 37, the feed pump 34, and the scavenge pump 33 are disposed in parallel in the pump axis direction. Similarly, the discharge ports 33*c*, 34*c*, 36*c*, and 37*c* of the first and second oil pumps 36 and 37, the feed pump 34, and the scavenge pump 33 are also disposed in parallel in the pump axis direction.

The pump rotors 36*d* and 37*d* each have a configuration composed of an outer rotor and an inner rotor, which is known in the art. The pump rotors 36*d* and 37*d* (inner rotors) can rotate integrally with the driving shaft 32. The width (thickness) of the pump rotor 37*d* in the pump axis direction is about two times the pump rotor 36*d*. That is, the basic discharge amount per rotation of the second oil pump 37 (pump capacity) is about two times the first oil pump 36.

In this configuration, the first and second oil pumps 36 and 37 has the same discharge cycle, but has about a half-cycle phase difference, such that generation of vibration of the lubrication system is suppressed.

Figure 7:
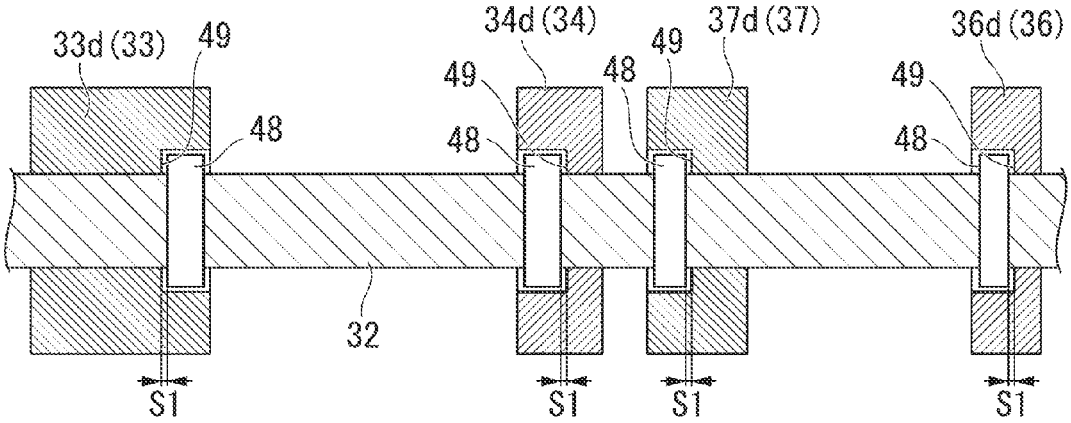
FIG. 7 is an enlarged view of the main parts of FIG. 6.

Referring to FIG. 7, a plurality of fitting pins 48 that integrally rotatably fit the pump rotors 33*d*, 34*d*, 36*d*, and 37*d* of the first and second oil pumps 36 and 37, the feed pump 34, and the scavenge pump 33 is fixed to the driving shaft 32. Fitting grooves 49 that is fitted on the corresponding fitting pin 48 are formed at the left sides of the pump rotors 34*d*, 36*d*, and 37*d* of the first and second oil pumps 36 and 37 and the feed pump 34 while a fitting groove 49 that fits the corresponding fitting pin 48 is formed at the right surface of the pump rotor 33*d* of the scavenge pump 33.

Further, a gap s1 in the axial direction of the driving shaft 32 (in the pump axial direction) is defined between the fitting pins 48 and the bottom surfaces of the fitting grooves 49, respectively.

The oil sucked in the first and second oil pump 36 and 37 is appropriately supplied to at least one of first and second return channel 63*a* and 66*a* reaching first and second oil supply channels 62*a* and 64*a*, which meets the oil supply channel 67, and the intake ports 36*b* and 37*b*, through the oil path switching valve 51 after being discharged through the discharge ports 36*c* and 37*c*.

Referring to FIG. 6, the oil path switching valve 51 is implemented a so-called spool valve that selectively switches the discharge ports 36*c* and 37*c* to communicate or not with the first and second oil pumps 36 and 37, the first and second oil supply channels 62*a* and 64*a*, and the first and second return channels 63*a* and 66*a*. The oil path switching valve 51 has a cylindrical valve body 52 in the longitudinal direction (left-right direction) and a valve main body 53 inserted in the valve body 52 to be able to reciprocate in the left-right direction. The oil path switching valve 51 is disposed under the driving shaft 32 when being mounted on the engine 13 (motorcycle 1) (see FIGS. 2 and 5). Further, reference numeral 'C2' indicates the center axis line of the oil path switching valve 51.

Referring to FIGS. 5 and 6, the valve body 52 is disposed separately from the pump body 38. A body-mounting surface 54 that is inclined rearward and downward when being mounted on the engine 13 is formed at the upper rear side of the right portion of the valve body 52 (an oil path forming portion 52*a* described below). The body-mounting surface 54 is flat in the left-right direction and aligned in oil tight from under the valve-mounting surface 55 formed at the lower portion of the valve body 52. In this state, the valve body 52 is fastened and fixed to the pump body 38 by a plurality of bolts 52*c*.

The left end of the valve body 52 is open to the left, and the valve main body 53 and a compression coil spring (hereafter, briefly referred to as a spring) 56 that urges the right side of the valve main body 53 are inserted in the valve body 52 by the left end. The left end of the valve body 52 is closed by an end cap 57 and the spring 56 is compressed at a predetermined amount between the end cap 57 and the valve main body 53.

A first inlet 61 that communicates with the discharge port 36*c* of the first oil pump 36 through the first introducing channel 61*a*, a first return hole 63 that communicates with the intake port 36*b* of the first oil pump 36 through the first return channel 63*a*, a second outlet 64 that communicates with the second oil supply channel 64*a*, a second inlet 65 that communicates with the discharge port 37*c* of the second oil pump 37 through the second introducing channel 65*a*, and a second return hole 66 that communicates with the intake port 37*b* of the second oil pump 37 through the second return channel 66*a* are sequentially provided from the right end, at the right end portion of the valve body 52. The first inlet 61 includes the first inlet 62 that communicates with the first oil supply channel 62*a*.

Hereinafter, it is assumed that in the oil path switching valve 51, the portion (right portion) where the inlets 61 and 65, the outlets 62 and 64, and the return holes 63 and 66 are formed is an oil channel forming portion 52*a* and the portion (left portion) that extends from the above portion and mainly accommodates the spring 56 is a driving portion 52*b*.

Figure 10:
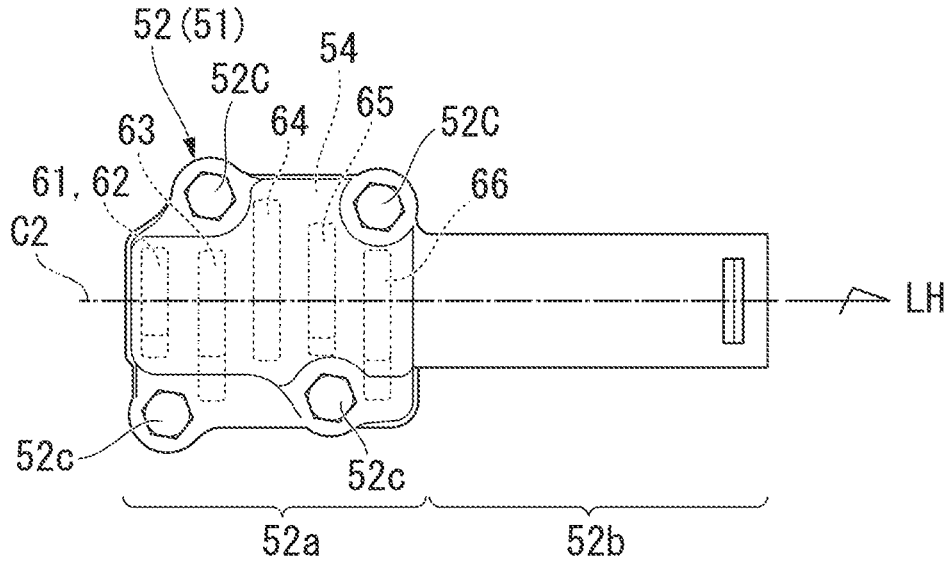
FIG. 10 is a view of the oil path switching valve seen in the B-direction of FIG. 5.
Figure 11:
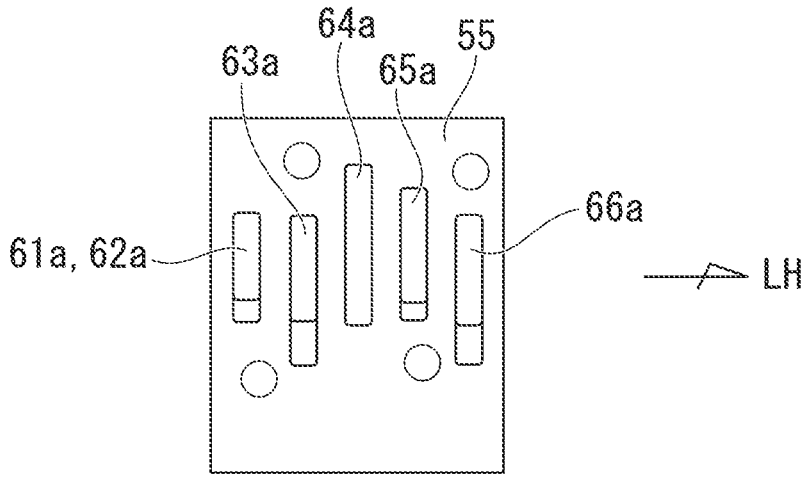
FIG. 11 is a view of a valve mounting surface of the oil pump unit, seen in the B-direction of FIG. 5.

Referring to FIGS. 10 and 11, the first inlet 61 (first outlet 62), the first return hole 63, the second leasing hole 64, the second inlet 65, and the second return hole 66 are sequentially open from the left side in a slit shape perpendicular to the pump axis direction, on the body-mounting surface 54 formed at the upper rear side of the oil forming portion 52*a*.

Meanwhile, the first introducing channel 61*a* (first oil supply channel 62*a*), the first return channel 63*a*, the second oil supply channel 64*a*, the second introducing channel 65*a*, and the second return channel 66*a* are open in a slit shape perpendicular to the pump axis direction, on the valve-mounting surface 55 formed at the lower front portion of the pump body 38.

In other words, on the valve-mounting surface 55, the discharge port 36*c* of the first oil pump 36 is open through the first introducing channel 61*a*, the intake port 36*b* of the first oil pump 36 is open through the first return channel 63*a*, the discharge port 37*c* of the second oil pump 37 is open through the second introducing channel 65*a*, and the intake port 37*b* of the second oil pump 37 is open through the second return channel 66*a*.

Referring to FIG. 6, the right portion of the valve main body 53 is a first valve portion 53*a* having a cylindrical shape with a bottom that is open to the right and the left portion of the valve main body 53 is a second valve portion 53*b* having a cylindrical shape with a bottom that is open to the left. The first valve portion 53*a* is inserted in the right side of the oil path forming portion 52*a* and the second valve portion 53*b* is inserted in the left side of the oil path forming portion 52*a*.

The valve portions 53*a* and 53*b* appropriately open/close the inlets 61 and 65 and the outlets 62 and 64 and the return holes 63 and 66, with the outer circumferential surface being in sliding contact with the inner circumferential surface of the oil path forming portion 52*a*.

The valve portions 53*a* and 53*b* are spaced from each other at the left and right and integrally connected through a connecting portion 53*c*. The connecting portion 53*c* has a rod shape thinner than the valve portions 53*a* and 53*b* and is inserted in the left side of the oil path forming portion 52*a* (in the second oil path switching portion 58*b*) together with the second valve portion 53*b*. A ring-shaped space 53*d* is formed between the outer circumferential surface of the connecting portion 53*c* and the inner circumferential surface of the oil path forming portion 52*a*.

Hereinafter, it is assumed that the right portion of the oil path forming portion 52*a* that accommodates the first valve portion 53*a* when the valve main body 53 moves to the right is a first oil path switching portion 58*a* and the left portion of the oil path forming portion 52*a* that accommodates the second valve portion 53*b* and the connecting portion 53*c* when the valve main body 53 moves to the right is a second oil path forming portion 58*b*.

The first inlet 61, the first leasing hole 62, and the first return hole 63 are open in the first oil path switching portion 58*a* while the second inlet 65, the second outlet 64, and the second return hole 66 are open in the second oil path switching portion 58*b*.

In the oil path forming portion 52*a*, the second oil path switching portion 58*b* corresponding to the second oil pump 37 having a relatively large discharge amount has a longitudinal width larger than the first oil path switching portion 58*a* corresponding to the first oil pump 36 having a relatively small discharge amount.

While the valve main body 53 moves to the right, oil can flows in between the right end portion of the first vale portion 53*a* and the right bottom portion of the valve body 52, and the first inlet 61 and the first outlet 62 disposed at the right end in the valve-longitudinal direction of the valve body 52 communicate with each other at the flow portion.

Accordingly, an oil pressure keeps applied from the discharge port 36*c* to the internal space of the first valve portion 53*a*. That is, the internal space of the first valve portion 53*a* is an oil pressure receiving portion 53*e* that keeps receiving the oil pressure from the first oil pump 36. The valve main body 53 is moved to the left against the urging force of the spring 56 by the oil pressure from the first oil pump 36 which the oil pressure receiving portion 53*e* receives.

An extender 53*f* formed in a slight thin cylindrical shape is integrally connected to the left side of the second valve portion 53*b*. The extender 53*f* is inserted in the driving portion 52*b*, with the spring 56 accommodated therein. The extender 53*f* guides expansion and contraction of the spring 56 when the valve main body 53 moves. The left end portion of the extender 53*f* is a stopper 53*g* that limits the movement by a predetermined distance or more to the left side of the valve main body 53 by hitting against the end cap 57 when the valve main body 53 moves to the left by a predetermined distance or more.

Referring to FIG. 6, when the valve main body 53 moves to the right, the first inlet 61 and the first outlet 62 communicate with each other while the second inlet 65 and the second outlet 64 communicate with each other through a space 53*d*. In this case, the first return hole 63 is closed to the first valve portion 53*a* and the second return hole 66 is closed to the second valve portion 53*b*.

Figure 8:
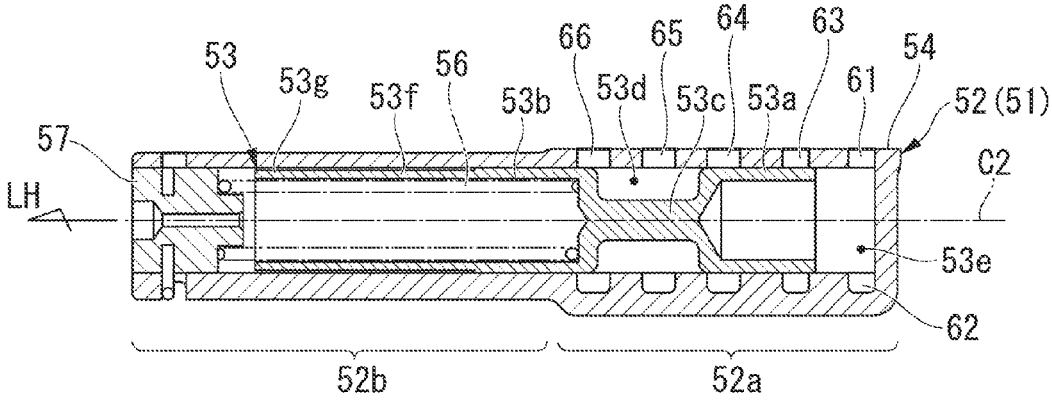
FIG. 8 is a first operation-illustrating view of the oil path switching valve.

Meanwhile, referring to FIG. 8, when the valve main body 53 moves to the left by a predetermined amount, the second outlet 64 is closed to the first valve portion 53*a* while the second inlet 65 and the second return hole 66 communicate with each other through the space 53*d*, with the first inlet 61 and the first outlet 62 communicating with each other. In this case, the second outlet 64 is closed to the first valve portion 53*a*.

Figure 9:
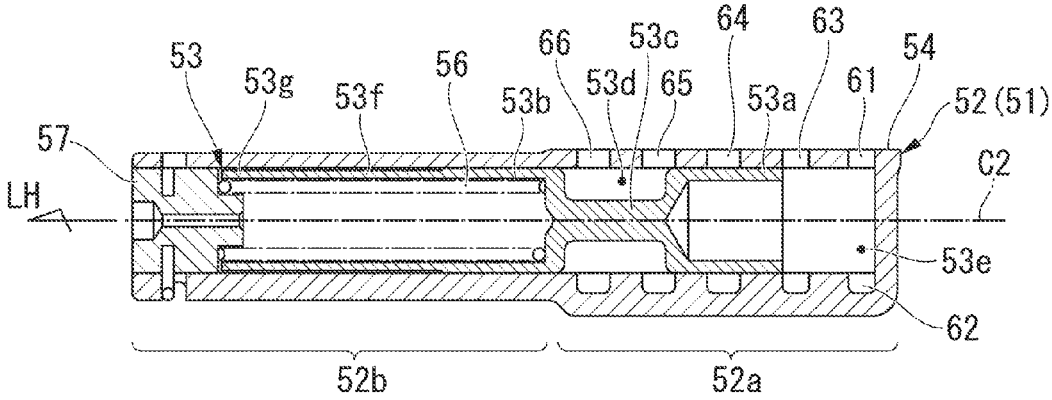
FIG. 9 is a second operation-illustrating view of the oil path switching valve.

Further, referring to FIG. 9, when the valve main body 53 further moves to the left, the first return hole 63 further communicates with the first inlet 61 and the first outlet 62.

Now, when the numbers of revolution of the engine 13 and the oil pump unit 31 are low and the discharge pressure of the first oil pump 36 is low, the valve main body 53 moves not to the left, but to the right (see FIG. 6). In this case, as described above, the first inlet 61 and the first outlet 62 communicating with each other while the second inlet 65 and the second outlet 64 communicate with each other through the space 53*d*. Accordingly, the entire oil pressure from the first and second oil pump 36 and 37 is supplied to the apparatus through the oil supply channel 67.

When the numbers of revolution of the engine 13 and the oil pump unit 31 increase and the discharge pressure of the first oil pump 36 increases from the state described above, the valve main body 53 moves to the left by a predetermined amount by receiving the oil pressure (see FIG. 8). In this case, as described above, the second outlet 64 is closed to the first valve portion 53*a* while the second inlet 65 and the second return hole 66 communicate with each other through the space 53*d*, with the first inlet 61 and the first outlet 62 communicating with each other. Therefore, the entire oil pressure from the first oil pump 36 is supplied to the apparatus through the oil supply channel 67 and the oil pressure from the second oil pump 37 returns to the intake port 37*b* of the second oil pump 37 through the second return channel 66*a*.

Thereafter, when the numbers of revolution of the engine 13 and the oil pump unit 31 further increase and the valve main body 53 further moves to the left, as described above, three portion of the first inlet 61, first outlet 62, and first return hole 63 communicate with each other (see FIG. 9). Accordingly, some of the oil pressure from the first oil pump 36 returns to the intake port 36*b* of the first oil pump 36 through the first return channel 63*a* as a remaining oil pressure. In this sate, the valve main body 53 is prevented from further moving to the left (the valve main body 53 has moved to the left).

Figure 12:
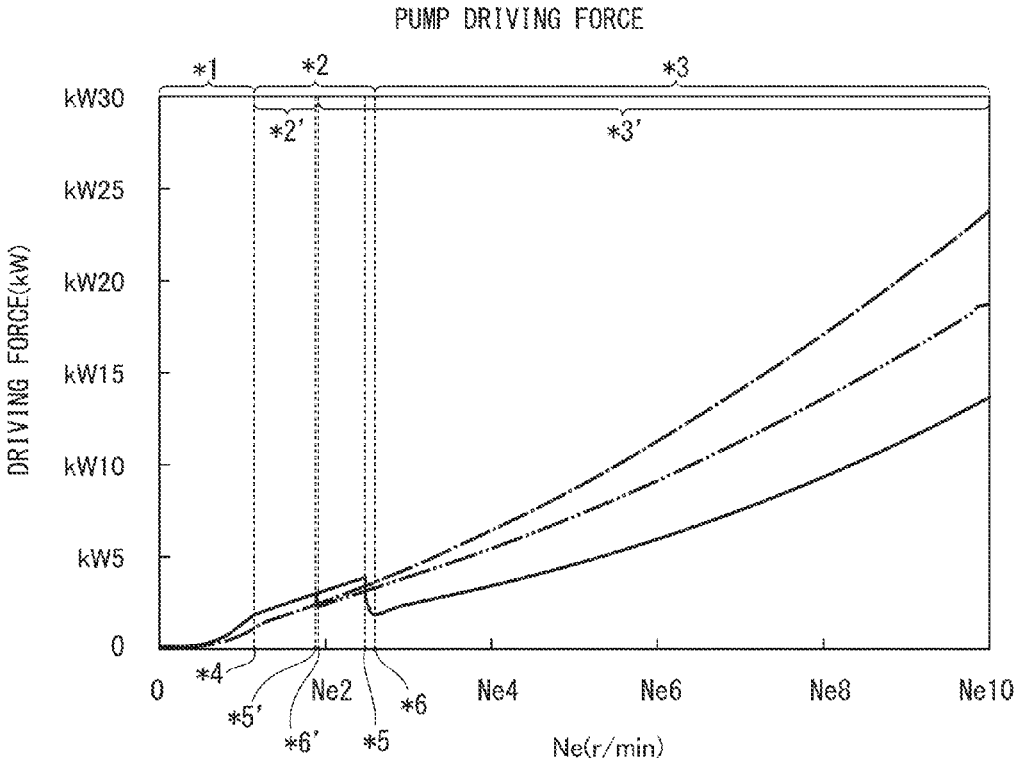
FIG. 12 is a characteristic diagram showing the relationship between the number of revolution of the engine and a pump driving force in the oil pump unit.
Figure 13:
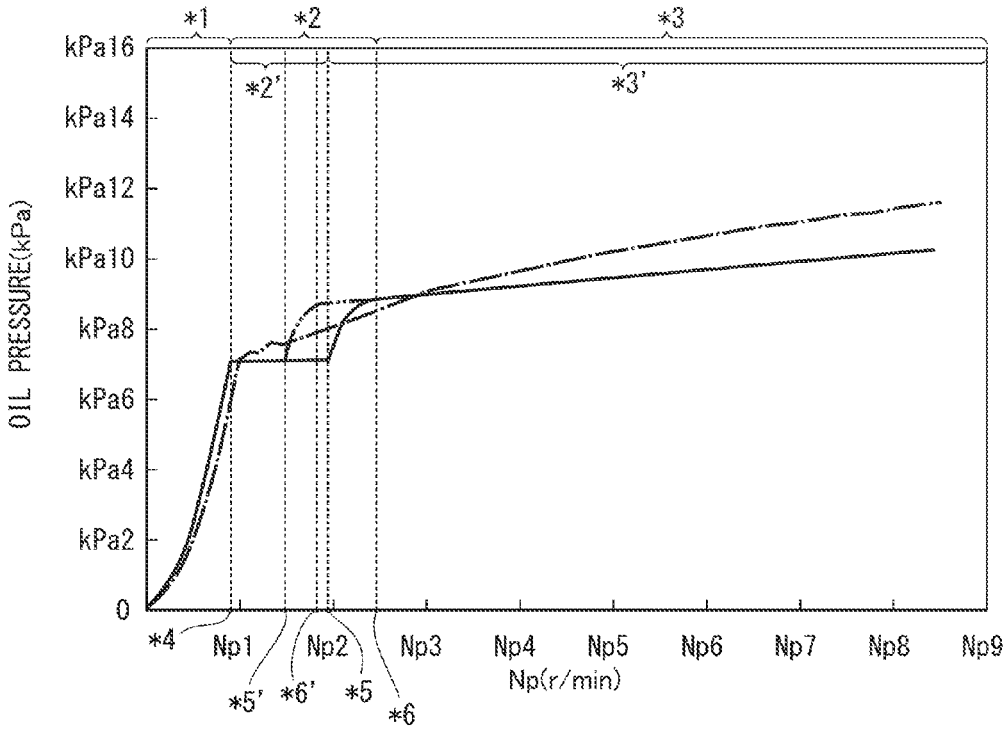
FIG. 13 is a characteristic diagram showing the relationship between the number of revolution of the pump and a generated oil pressure in the oil pump unit.
Figure 14:
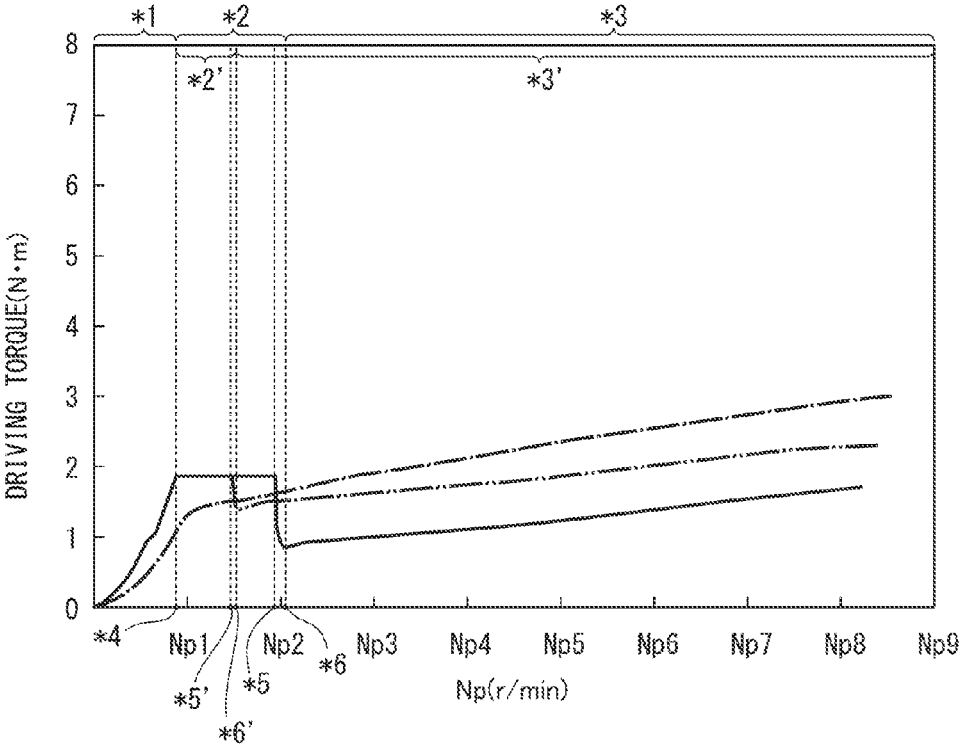
FIG. 14 is a characteristic diagram showing the relationship between the number of revolutions of the pump and driving torque in the oil pump unit.

FIG. 12 is a graph showing the relationship between the number of revolution of the engine 13 (r/min, additionally the number of revolution of the oil pump unit 31) and the pump driving force (kW), FIG. 13 is a graph showing the relationship between the number of revolution (r/min) of the oil pump unit 31 and the generated oil pressure (kPa), and FIG. 14 is a graph showing the relationship between the number of revolution (r/min) of the oil pump unit 31 and the pump driving force (Nm).

In FIGS. 12 to 14, the characteristic line of the oil pump unit 31 of the embodiment (the capacity of the second oil pump 37 is approximately two times the capacity of the first oil pump 36) is shown by a solid line, the characteristic lien when the pump capacities of the first and second oil pumps 36 and 37 are the same is shown by a two-dot chain line, and the characteristic line of the oil pump unit 31 when the oil path switching valve 51 is provided is shown by a one-dot chain line.

Further, in the figures, reference numeral "*1" indicates a low revolution area where the vale main body 53 of the oil pump unit 31 does not move (has moved to the right), reference numeral "*2" indicates a mid-revolution area where the vale main body 53 of the oil pump unit 31 moves to the left by a predetermined amount, and reference numeral "*3" indicates a high revolution area where the vale main body 53 of the oil pump unit 31 has moved to the left. Further, in the figures, reference numeral "*2" indicates an area corresponding to the area *2 when the pump capacities of the oil pumps 36 and 37 are the same and reference numeral "*3'" indicates an area *3 corresponding to the area when the pump capacities of the oil pumps 36 and 37 are the same.

Further, in the figures, reference numeral "*4" indicates the number of revolution where the vale main body 53 of the oil pump unit 31 starts to move, reference numeral "*5" indicates the number of revolution where the second outlet 64 is closed while the second inlet 65 and the second return hole 66 communicate with each other in the oil pump unit 31, and reference numeral "*6" indicates the number of revolution where three portions of the first inlet 61, first outlet 62, and first return hole 63 communicate with each other in the oil pump unit 31. Further, in the figures, reference numeral "*5'" indicates the number of revolution corresponding to the number of revolution *5 when the pump capacities of the oil pumps 36 and 37 are the same and reference numeral "*6'" indicates the number of revolution corresponding to the number of revolution *6 when the pump capacities of the oil pumps 36 and 37 are the same.

As described above, the oil pump unit with a variable flow rate includes lubrication pumps (the feed pump 34 and the scavenge pump 33) and the control pump 35 that are driven by rotation of a crankshaft 21 of an engine 13, and changes the oil supply amount from the control pump 35 to each part of the engine, in which the control pump 35 includes a plurality of oil pumps 36 and 37 that have different discharge rates.

In more detail, the oil pump unit with a variable flow rate includes the oil path switching valve 51 that switches the discharge ports 36*c* and 37*c* of the control pump 35 to communicate or not with the oil supply channel 67 leading to each part of the engine such that the oil supply amount from the control pump 35 to each part of the engine is variable, in which one of the oil pumps 36 and 37 (first oil pump 36) is a main pump 36 that is kept communicating with the oil supply channel 67 leading to each part of the engine while the other (second oil pump 37) of the oil pumps 36 and 37 is a sub-pump 37 that is switched to communicate or not with the oil supply channel 67 by operation of the oil path switching valve 51, and the discharge rate of the sub-pump 37 is set to be larger than the discharge rate of the main pump 36.

According the configuration, since it is possible to more fine control the entire discharge amount of the pump, as compared with a control pump 35 includes a single oil pump, it is possible to further reduce the pump driving force.

Further, according to the configuration, it is possible to increase the control width of the discharge amount of the entire pump and further reduce the pump driving force, by making the discharge amount of the sub-pump 37, which is switched to communicate or not with the oil supply channel 67 to the part of the engine by the operation of the oil path switching valve 51, larger than the discharge amount of the main pump 36 that is kept communicating with the oil supply channel 67 to the part of the engine.

Further, in the oil pump unit with a variable flow rate, the oil path switching valve 51 is operated by a discharge pressure from the main pump 36, such that it is possible to easily operate the oil path switching valve 51, using the discharge pressure of the main pump 36 and it is possible to use the oil path switching valve 51 as a relief valve of the main pump 36.

Further, in the oil pump unit with a variable flow rate, the lubrication pumps 33 and 34 and the control pump 35 are disposed on the same axis, such that it is possible to reduce the size, weight, and cost by reducing the number of parts and simplifying the structure, as compared with the pumps 33 to 35 are disposed on separate axes.

Further, in the oil pump unit with a variable flow rate, the main pump 36 and the sub-pump 37 share a single pump body 38 and the main pump 36 is disposed at the outer side of the pump body 38 than the sub-pump 37 in the axial direction of the main pump 36 and the sub-pump 37, such that it is possible to dispose the sub-pump 37 that generates a loud operation sound due to a relatively large discharge amount inside the pump body 38, it is possible to reduce the operation sound of the entire pump.

Further, in the oil pump unit with a variable flow rate, the pump driving unit (the driven member 32*a*) is disposed at a side of the main pump 36 in the axial direction of the main pump 36 and the sub-pump 37, such that since it is possible to disposed the main pump 36 that keeps receiving a driving load close to the pump driving unit, it is possible to reduce the load at the driving shaft 32.

Further, in the oil pump unit with a variable flow rate, the main pump 36 and the sub-pump 37 have the same discharge cycle and an about half-cycle phase difference, such that it is possible to effectively suppress pulsation that is generated by the main pump 36 and the sub-pump 37.

Further, in the oil pump unit with a variable flow rate, the lubrication pumps 33 and 34 and the control pump 35 share a single driving shaft 32, a plurality of engaging portions 48 that is engaged with pump rotors 33*d*, 34*d*, 36*d*, and 37*d* of the pumps 33 to 35 in a non-relative rotatable state is formed at the driving shaft 32, and a gap s1 is set between the engaging portions 48 and engaged portions 49 of the pump rotors 33*d*, 34*d*, 36*d*, and 37*d* that are engaged with the engaging portions 48, respectively, in the axial direction of the driving shaft 32, such that since it is possible to absorb expansion and contraction, using the gap s1, when the expansion and contraction is generated in the driving shaft 32, it is possible to suppress an increase in the friction of the pump rotors 33*d*, 34*d*, 36*d*, and 37*d*, even if the pump rotors 33*d*, 34*d*, 36*d*, and 37*d* are axially located with the sides of the pump rotors 33*d*, 34*d*, 36*d*, and 37*d* of the pumps 33 to 35 in sliding contact with the inner side of the pump body 38.

Further, the present invention is not limited to the embodiments described above, and may be applied to an oil pump unit with a variable flow rate, for example, having a configuration without the scavenge pump or a configuration in which the control pump includes three or more oil pumps. Further, the present invention is not limited to the V-type engine, and may be applied to various kinds of engines, such as a series type engine or a single-cylinder engine.

Further, the configuration of the embodiments described above is an example of the present invention, which is not limited to a motorcycle (including a bicycle equipped with a power engine a scooter type vehicle), and may be applied to a three-wheel (including a vehicle with two front wheels and one rear wheel, in addition to a vehicle with one front wheel and two rear wheels) or a four-wheel vehicle, such that it can be modified in various ways without departing from the present invention.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. An oil pump unit with a variable flow rate comprising a lubrication pump; and a control pump that includes a main pump and a sub-pump that have different discharge rates, wherein the lubrication pump and the control pump are disposed so as to share a rotational axis and are driven by rotation of a crankshaft of an engine, wherein an oil supply amount from the control pump to each part of the engine is variable, and wherein the sub-pump is disposed so as to be between the main pump and the lubrication pump along the rotational axis.

2. An oil pump unit with a variable flow rate comprising:

lubrication pumps; and a control pump, wherein the lubrication pumps and the control pump are disposed so as to share a rotational axis and are driven by rotation of a crankshaft of an engine, and wherein the control pump includes an oil path switching valve that switches a discharge port of the control pump to communicate or not with an oil supply channel leading to each part of the engine such that the oil supply amount from the control pump to each part of the engine is variable, wherein the control pump includes a plurality of oil pumps that have different discharge rates, at least one of the plurality of oil pumps is a main pump that is kept communicating with the oil supply channel while the other of the plurality of oil pumps is a sub-pump that is switched to communicate or not with the oil supply channel by an operation of the oil path switching valve, and a discharge rate of the sub-pump is set larger than a discharge rate of the main pump, and the sub-pump is disposed so as to be between the main pump and the lubrication pumps along the rotational axis.

3. The oil pump unit with a variable flow rate according to claim 2, wherein the oil path switching valve is operated by a discharge pressure from the main pump.

4. The oil pump unit with a variable flow rate according to claim 2, wherein the main pump and the sub-pump share a single pump body.

5. The oil pump unit with a variable flow rate according to claim 2, wherein a pump driving unit is disposed at a side of the main pump in the axial direction of the main pump and the sub-pump.

6. The oil pump unit with a variable flow rate according to claim 2, wherein the main pump and the sub-pump have a same discharge cycle and a substantially half-cycle phase difference.

7. The oil pump unit with a variable flow rate according to claim 2, wherein the lubrication pumps and the control pump share a single driving shaft, a plurality of engaging portions that are engaged with pump rotors of the plurality of oil pumps in a non-relative rotatable state are formed at the driving shaft, and a gap is set in the axial direction of the driving shaft between the engaging portions and engaged portions of the pump rotors that are engaged with the engaging portions, respectively.

* * * * *